US010008341B2

(12) United States Patent
Nayak et al.

(10) Patent No.: US 10,008,341 B2
(45) Date of Patent: Jun. 26, 2018

(54) MONOLITHIC CONTACT SYSTEM AND METHOD OF FORMING

(71) Applicant: General Electric Company, Schenectady, NY (US)

(72) Inventors: Mohandas Nayak, Karnataka (IN); Nagaveni Karkada, Karnataka (IN); Shalini Thimmegowda, Karnataka (IN); Mallikarjuna Heggadadevanapura Thammaiah, Karnataka (IN); Janakiraman Narayanan, Andhra Pradesh (IN); Linda Yvonne Jacobs, Barkhamsted, CT (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 342 days.

(21) Appl. No.: 14/571,739

(22) Filed: Dec. 16, 2014

(65) Prior Publication Data

US 2015/0170846 A1 Jun. 18, 2015

(30) Foreign Application Priority Data

Dec. 16, 2013 (IN) ..... 5861/CHE/2013

(51) Int. Cl.
*H01H 1/02* (2006.01)
*H01H 1/021* (2006.01)
(Continued)

(52) U.S. Cl.
CPC ..... *H01H 1/021* (2013.01); *B22F 3/04* (2013.01); *B22F 3/105* (2013.01); *B22F 3/14* (2013.01);
(Continued)

(58) Field of Classification Search
CPC ..... H01H 1/021; H01H 1/025; H01H 11/048; H01H 1/0237; H01H 1/0233; B60Q 9/00;
(Continued)

(56) References Cited

U.S. PATENT DOCUMENTS 2,694,759 A 11/1954 Thumim
4,137,076 A 1/1979 Hoyer et al.
(Continued)

FOREIGN PATENT DOCUMENTS

CN 1102502 A 5/1995
CN 101572194 A 11/2009
(Continued)

OTHER PUBLICATIONS

Michal, R., et al., "Application of silver-based contact materials in air-break switching devices for power engineering", Journal of the Electrical Contacts, IEEE, Sep. 26-29, 1988, pp. 121-127,San Francisco, CA, USA.
(Continued)

*Primary Examiner* — Edwin A. Leon
*Assistant Examiner* — Lheiren Mae A Caroc
(74) *Attorney, Agent, or Firm* — GE Global Patent Operation; Stephen G. Midgley

(57) ABSTRACT

A circuit breaker having a monolithic structure and method of making is disclosed. The monolithic structure includes an arm portion having copper and a contact portion having a composite material. The composite material has a metallic matrix and a second phase disposed in the metallic matrix. The method of making the monolithic structure includes introducing a first powder into a first region of a mold, introducing a second powder into a second region of the mold, and consolidating the first powder and the second powder together. The first region of the mold corresponds to
(Continued)

a contact portion, and the second region corresponds to an arm portion of the monolithic structure of the circuit breaker.

15 Claims, 5 Drawing Sheets

(51) Int. Cl.

| | |
|---|---|
| ***H01H 1/025*** | (2006.01) |
| ***H01H 11/04*** | (2006.01) |
| ***B22F 3/04*** | (2006.01) |
| ***B22F 3/105*** | (2006.01) |
| ***B22F 3/14*** | (2006.01) |
| ***B22F 3/16*** | (2006.01) |
| ***B22F 7/06*** | (2006.01) |
| ***C22C 32/00*** | (2006.01) |
| *H01H 1/0233* | (2006.01) |
| *H01H 1/0237* | (2006.01) |
| *B22F 3/12* | (2006.01) |
| *B22F 5/00* | (2006.01) |

(52) U.S. Cl.
CPC ..... *B22F 3/16* (2013.01); *B22F 7/06* (2013.01); *C22C 32/0021* (2013.01); *C22C 32/0047* (2013.01); *C22C 32/0084* (2013.01); *H01H 1/025* (2013.01); *H01H 11/048* (2013.01); *B22F 3/12* (2013.01); *B22F 5/00* (2013.01); *B22F 2999/00* (2013.01); *H01H 1/0233* (2013.01); *H01H 1/0237* (2013.01)

(58) Field of Classification Search
CPC ..... B60Q 1/1476; B22F 3/14; B22F 3/105; B22F 7/06; B22F 3/16; B22F 3/04; B22F 2999/00; B22F 5/00; C22C 32/0047; C22C 32/0021; C22C 32/0084
USPC ..... 200/262–265, 268
See application file for complete search history.

(56) References Cited

U.S. PATENT DOCUMENTS

| | | | | |
|---|---|---|---|---|
| 4,345,130 | A * | 8/1982 | Okutomi | H01H 1/023 200/268 |
| 4,622,269 | A * | 11/1986 | Leung | H01H 1/0231 200/265 |
| 4,680,438 | A * | 7/1987 | Witting | C23C 14/0641 200/268 |
| 4,699,763 | A | 10/1987 | Sinharoy et al. | |
| 4,909,841 | A | 3/1990 | Iyer et al. | |
| 4,999,464 | A | 3/1991 | Bellino et al. | |
| 4,999,646 | A * | 3/1991 | Trask | B41J 2/2132 347/41 |
| 6,437,266 | B1 * | 8/2002 | Pannenborg | H01H 11/045 200/262 |
| 7,598,832 | B2 * | 10/2009 | Rival | H01H 1/027 200/262 |
| 8,007,301 | B2 | 8/2011 | Andersen et al. | |
| 2015/0083558 | A1 * | 3/2015 | Malacara-Carrillo | H01H 1/023 200/266 |

FOREIGN PATENT DOCUMENTS

| | | | |
|---|---|---|---|
| CN | 101608272 | A | 12/2009 |
| GB | 1242004 | A | 8/1971 |

OTHER PUBLICATIONS

Streicher, E., et al., "Press-sinter-repress Ag—SnO2 contacts with lithium and copper sintering additives for contractor applications", Journal of the Electrical Contacts, IEEE, 2001, pp. 27-34, Montreal, Quebec.

Leung, C.-H., et al., "Comparison of Reignition Properties of Several Ag/W, Ag/WC, and Ag/Mo Electrical ContactMaterials", Journal of the Components, Hybrids, and Manufacturing Technology, IEEE, Mar. 1986, pp. 86-91, vol. 9 , Issue: 1.

Wingert P.C.. "The effects of nickel on the switching performance of silver-tungsten-based contacts", Journal of the Electrical Contacts, IEEE, Sep. 27-29, 1993, pp. 111-115,Pittsburgh, PA.

Machine Translation and First Office Action and Search issued in connection with corresponding CN Application No. 201410781888.7 dated Aug. 1, 2017.

* cited by examiner

MONOLITHIC CONTACT SYSTEM AND METHOD OF FORMING

BACKGROUND

The present invention relates generally to a contact-arm assembly having an electrical contact in an electrical circuit breaker. More specifically, the invention relates to a circuit breaker including a monolithic contact-arm structure and method of forming the same.

Contacts and contact arm assemblies are well known in the art of circuit breakers. Contact arm assemblies having electrical contacts for making and breaking an electrical current are not only employed in electrical circuit breakers, but also in other electrical devices, such as rotary double break circuit breakers, contactors, relays, switches, and disconnects.

The primary function of a contact-arm assembly is to provide an electrical current carrier that is capable of being actuated to separate the contact from a second contact, thereby enabling the making and breaking of an electrical current in an electric circuit.

The contact is generally bonded to the contact arm, which is typically, but not necessarily, a copper alloy. The contacts are generally joined to the arm by a brazing process using a braze alloy. Usage of braze alloy at the joining interface may lead to voids and defects at the interface. These process defects can act as heat pockets during an arcing event and become a primary reason for contact failure. Hence there is a need for improved joining of the contact and arm that can tolerate thermal, electrical and mechanical stresses, provide improved heat transfer between contact and arm, and improve the reliability of the assembly, during operation of the host device. The system and method presented herein are directed towards addressing this need.

BRIEF DESCRIPTION

In one embodiment, a circuit breaker having a monolithic structure is disclosed. The monolithic structure includes an arm portion having copper and a contact portion having a composite material. The composite material has a metallic matrix and a second phase disposed in the metallic matrix.

In one embodiment, a circuit breaker having a monolithic structure is disclosed. The monolithic structure includes an arm portion having copper and a contact portion having a composite material. The composite material has a silver matrix and a second phase disposed in the silver matrix. The contact portion further has a gradient in chemical composition.

In one embodiment, a method of fabricating a circuit breaker is disclosed. The method of fabricating the circuit breaker includes the method of formation of a monolithic structure. The method of forming the monolithic structure includes introducing a first powder having a composite material into a first region of a mold, and introducing a second powder having copper into a second region of the mold, and consolidating the first powder and the second powder together. The first region of the mold corresponds to a contact portion, and the second region corresponds to an arm portion of the monolithic structure of the circuit breaker.

In one embodiment, a method of fabricating a circuit breaker is disclosed. The method of fabricating the circuit breaker includes the method of formation of a monolithic structure. The method of forming the monolithic structure includes introducing a first powder having about 20 wt % silver and 80 wt % tungsten into a first region of a mold, introducing a copper powder into a second region of the mold, and consolidating the first powder and the second powder together. The first region of the mold corresponds to a contact portion, and the second region corresponds to an arm portion of the monolithic structure of the circuit breaker. The consolidation includes uniaxially co-pressing the powders in the first and second regions in the mold to form a green monolithic structure having the arm portion and the contact portion, cold isostatic pressing of the green monolithic structure to form a densified green monolithic structure, and co-sintering the densified green monolithic structure at a temperature range of about 1000° C. to about 1020° C. for about an hour in an atmosphere comprising hydrogen and nitrogen.

DETAILED DESCRIPTION

The systems and methods described herein include embodiments that relate to a contact-arm assembly having an improved bond between contact and arm, thereby enabling the contact-arm assembly to withstand thermal, electrical, and mechanical stresses.

In the following specification and the claims that follow, the singular forms "a", "an" and "the" include plural referents unless the context clearly dictates otherwise.

As used herein, the term "adjacent" or "proximate" when used in context of discussion of different compositions or structure of regions or surfaces refers to "immediately next to" and it also refers to the situation wherein other components that are present between the components under discussion do not vary much with regards to the compositions or structure respectively of at least any one of the components.

Figure 1:
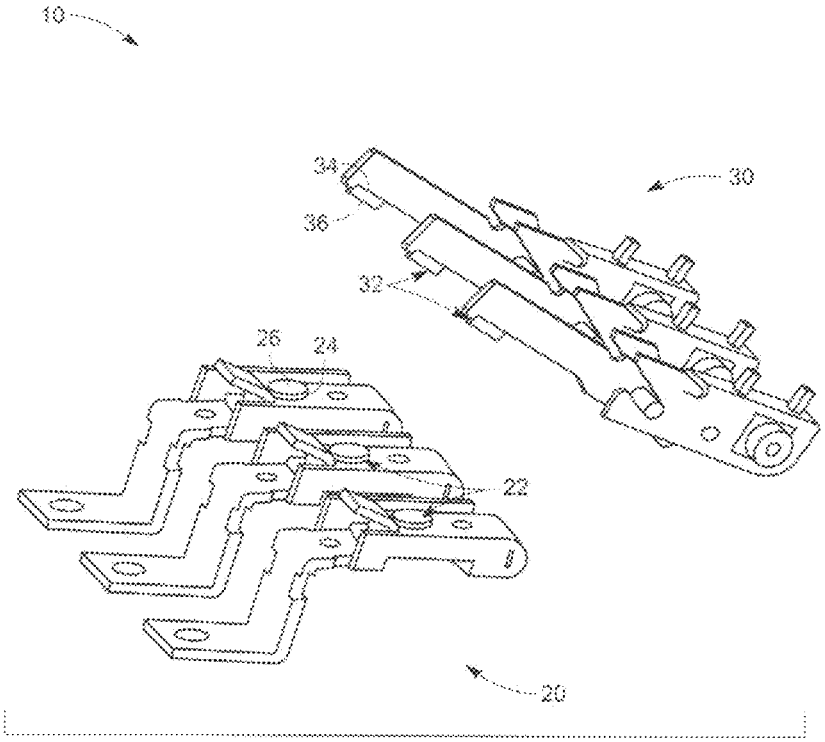
FIG. 1 is a schematic diagram of a circuit breaker system including an arm portion and a contact portion, in accordance with one embodiment of the invention.

Referring now to FIG. 1, an exemplary circuit breaker system 10 is shown. The circuit breaker system 10 includes a stationary arm 20 having a fixed contact 22 joined to the arm 20 at an interface 24. The fixed contact 22 has a fixed arcing surface 26. The circuit breaker system further includes a moving arm 30 having a movable contact 32 joined to the arm 30 at an interface 34. The movable contact 32 has an arcing surface 36.

During operation, an electric arc occurs between two contacts 22 and 32 at the arcing surfaces 26, 36 whenever fault current or short circuit happens. The high heat produced by the electric arc may melt both arcing surfaces 26 and 36, and a poor interfacial strength between the contacts 22, 32 and the arms 20, 30 at the interface 24, 34 respectively may result in failure of the contacts between the arms 20, 30 and the contacts 22, 32 respectively.

Figure 2:
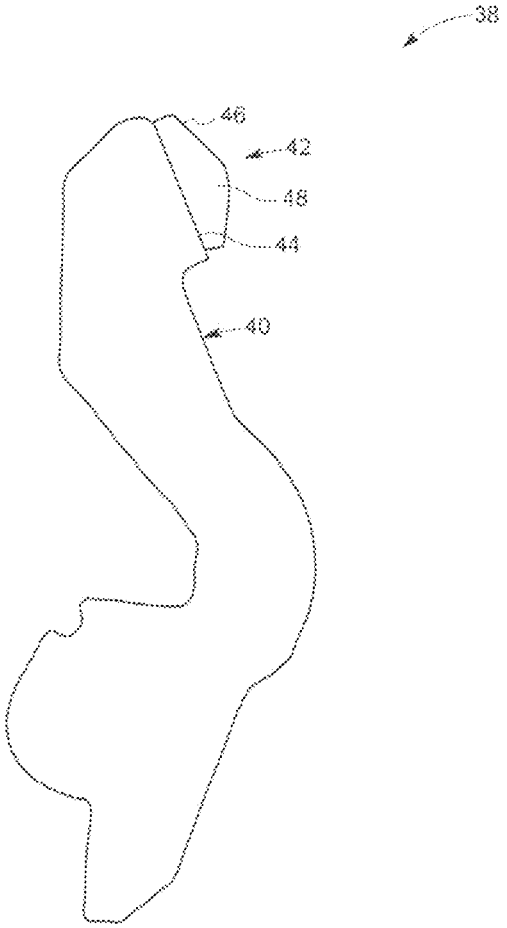
FIG. 2 is a schematic diagram of a monolithic structure, in accordance with one embodiment of the invention.

For brevity, different aspects of the current invention will be described further with an example of an arm portion 40 with the contact portion 42, having an interface 44 as shown in FIG. 2. The arm portion 40 and contact 42 may be the parts of a fixed arm 20, movable arm 30, or any other arms used in the circuit breaker depending on the design and application of the circuit breakers.

As used herein an arm "portion" 40 is the body portion that is joined to the contact portion 42 at the interface 44. As described above, a high reliability of bonding between the arm portion 40 with the contact portion 42 at the interface 44 is desired for increased life of the electrical switch gear. The interface 44 is normally formed by brazing or welding of the contact portion 42 with the arm portion 40, in most of the conventional electrical switch gears. Some embodiments of the present invention provide a new method of fabricating the contact-arm interface 44 without using brazing or welding, and thereby eliminating voids in the interface 44.

In one embodiment, a circuit breaker system 10 includes a monolithic structure 38 including an arm portion 40 and a contact portion 42 as shown in FIG. 2. The arm portion 40 includes copper as a part of the material composition. The arm portion 40 may include copper, an alloy of copper, or a composite of copper. The arm portion 40 has a substantial electrical conductivity (at least 90% of the electrical conductivity of copper) and substantially stable (at least 90% of the mechanical, thermal, and oxidation stability of copper) at the atmosphere and temperature of operation of a switch gear. In one particular embodiment, the arm portion 40 is made of substantially 100% copper. As used herein, "substantially 100%" is used to define the intended 100% composition, but may include any impurities that would not unduly degrade the performance of the arm portion 40, and further would include any impurities that would have incidentally became incorporated at the body or surfaces during processing. As used herein, the percentages mentioned are weight percentages.

In one embodiment, the contact portion 42 includes a composite material. The composite material of the contact portion 42 may have a metallic matrix and a second phase disposed in that metallic matrix. The metallic matrix may have copper, silver, or a combination of copper and silver. Silver is considered to be an excellent contact material because of its high thermal and electrical conductivity and considerable inertness to oxygen, and nitrogen. However, silver has a low melting point, making it prone to fusion and sticking. Further, silver is an expensive material to be used in large quantities. To overcome these challenges, in one embodiment, silver alloys or metal mixtures are used along with silver to increase hardness.

The second phase disposed in the metallic matrix may have a metal, an alloy, a carbide, an oxide, a nitride, carbon, or any combinations of these. As used herein, the "carbon" may be in a free form, without being a part of any other compounds. In one embodiment, the carbon of the second phase is in the graphite form. Thus, in one embodiment, the composite material of the contact portion 42 may have silver-graphite (alternately silver-carbon) in a mixture form, where the silver is the matrix, and carbon is the second phase material. The silver and carbon do not generally react with each other to form a compound.

In one embodiment, the second phase includes tungsten, molybdenum, nickel, or any combinations thereof. In one embodiment, the matrix and second phase may be in a metal mixture form. A "metal mixture" as used herein is a mixture of the matrix metal with a metal, non-metal, an alloy, or a compound of metal and non-metal.

In one embodiment, nickel, carbon, tungsten, molybdenum, cadmium oxide, or tungsten carbide are included as individual second phases disposed in a matrix that includes silver, copper, or silver and copper. In one embodiment, the composite includes silver-graphite, silver-tungsten, silver-nickel, silver-tungsten carbide, silver-molybdenum, or any combinations of these. In one embodiment, the silver is used in a mixture form with cadmium oxide for high temperature stability, faster arc quenching, and reduced erosion.

The carbides present as a part of the second phase may be refractory carbides. In one embodiment, the composite has silver in a mixture form with tungsten carbide. The amount of tungsten in the silver tungsten carbide metal mixture may be greater than about 50%. In one embodiment, the composite of the contact portion 42 has tungsten in an amount from about 50 wt % to about 80 wt %. This composition gives the composite a high electrical and thermal conductivity, and reduced contact wear.

In one embodiment, the contact portion 42 has a gradient. The term "gradient" as used herein means the value of a characteristic parameter of the structure changes with a change in position in the direction from arcing surface to the interface. The characteristic parameter may be composition, density, thickness, reactivity, or microstructure, for example. In one embodiment, the gradient is in the composition of the contact portion 42. In one embodiment, the contact portion 42 has a gradient in the chemical composition of the metal mixture.

In one embodiment, the gradient is from an arcing surface 46 to the interface 44. In another embodiment, the gradient is from the arcing surface to the center 48 of the contact portion 42. In this embodiment, a weight averaged concentration of the second phase in an intermediate region 48 (such as, for example, center) of the contact portion 42 is substantially higher than the concentration of the second phase at the arcing surface 46 or the interface 44, when compared to the concentration of silver or copper in those respective regions.

As alluded to above, in one embodiment the circuit breaker system 10 includes the monolithic structure 38 (FIG. 2). As used herein a "monolithic structure" is a continuous structure substantially free of voids at the interface region 44. An interface 44 is considered to be substantially free of voids when the percentage of the voids at the interface region 44 is less than 5% of the total interfacial area of the interface region 44. In the structure 38, the interfacial area of interface region 44 is the contact area of the arm portion 40 and the contact portion 42.

A typical brazed interface region of an arm portion and a contact portion of a circuit breaker may have greater than about 10 volume percent of voids in its interface region, and hence is not considered as providing a monolithic structure of arm and contact together.

Further, a percentage bonding between the arm portion 40 and the contact portion 42 at the interface region 44 of the monolithic structure is more than 98%. As used herein a "percentage bonding" is a percentage of the grains of the arm portion 40 bonded to the grains of the contact portion 42 at the interface region 44, as compared to the total number of grains of the arm portion 40 present in the interface region 44. It is to be understood that the "grains of the arm portion" used herein denote those grains which are having at least one grain of the contact portion 42 as a nearest neighbor. The percentage bonding between an arm portion and a contact portion of a conventional joint such as a brazed joint is typically less than about 85%.

An increased percentage bonding between the arm portion 40 and the contact portion 42 reduces joint resistance and improves heat transfer between the arm portion 40 and the contact portion 42 at the interface region 44 and further prevents contact failure at interface region 44. In one embodiment, the percentage bonding of the monolithic structure at the interface is more than about 99%.

In one embodiment, a percentage density of the interface region 44 is comparable with the percentage density of the arm portion 40 or the percentage density of the contact portion 42. Depending on the material and composition of the arm portion 40 and the contact portion 42, the absolute densities of the arm portion 40 and the contact portion 42, and hence the interface region 44 may be different. However, as used herein a "percentage density" is the density of the portion/region as a percentage of the theoretical density of that material. The percentage density of the interface region 44 is considered to be comparable with the percentage density of the arm portion 40 and the contact portion 42, if the difference in the percentage density value is less than 5 percentage points. In one embodiment, the percentage density of the monolith structure as a whole is about 96%. In one embodiment, the percentage density of the interface region 44 is about 96% of the theoretical density of the material composition of the interface region.

In one embodiment, the monolithic structure 38 has an interfacial region hardness that is within about 5% of the hardness of the arm portion 40, hardness of the contact portion 42, or the hardness of both the arm portion 40 and the contact portion 42. In one embodiment, the hardness of the monolith at the interface region 44 is comparable (i.e. variation less than 5%) with the hardness of the arm portion 40 or hardness of the contact portion 42, whichever is lower between the two.

In one embodiment, the monolithic structure 38 has a mechanical strength at the interface region 44 that is comparable to the mechanical strength of the arm portion 40 or the contact portion 42. The mechanical strength is considered to be comparable to the arm portion if the strength value is within 90% of the mechanical strength value of the arm portion.

A conventional joint, such as a brazed joint, may have delamination problems at the interface region at an operational temperature that is near or more than the temperature of the melting point of the brazing material employed at the interface. A monolithic structure 38 of various embodiments of this invention does not have such delamination issues at the interface region 44, due to the absence of brazing material.

In one embodiment, the monolithic structure 38 of the circuit breaker 10 includes a binder, a sintering aid, or a binder and a sintering aid. A "binder" as used herein increases wettability and flowability of the composition to which it is mixed. A "sintering aid" is a material that aids sintering of a composition at a lower temperature as compared to the sintering temperature of a composition without the sintering aid. Materials such as zinc, tin, aluminum, magnesium, silver, cobalt, nickel, iron, or any combinations of them may be used as a binder, sintering aid or both. In one example, cobalt, zinc, tin, magnesium, or aluminum are used as binders. Silver may be used as a sintering aid for copper. Similarly, nickel, and iron may be used as sintering aids. In one example, cobalt is used as a binder for the composite having tungsten carbide as a second phase.

At the interface region 44, the material of the arm portion 40 and the material of the contact portion 42 meet each other. The interface region may be of any shape, depending on the method of formation and the design requirement of the applications. For example, in one embodiment, the interface region 44 is a circular cross section of the joining region between the arm portion 40 and the contact portion 42 as shown in FIG. 2. The interface region may be in any other shape or contour providing more interfacial area for joining the arm portion 40 and the contact portion 42.

At the interface region 44, material of the arm portion 40 may react with the material of the contact portion 42. The reaction may enable strong bonding between the two portions. The composition of the arm portion 40 and the composition of the contact portion 42 at the interface region 44 may influence strength of the interface region 44. In one embodiment, the compositions of the arm portion 40 and the contact portion 42 at the interface 44 are designed such that a strong bonding is achieved by the reaction between the two compositions.

In one embodiment, the arm portion 40 is made up of copper material and the contact portion 42 is a composite having a copper matrix. The second phase of the composite may be a carbide or an oxide. In one embodiment, the contact portion 42 joining the copper arm portion 40 is a composite of copper and tungsten carbide.

In one embodiment, the arm portion 40 is made up of copper material and the contact portion 42 is a composite having silver matrix. In one embodiment, the interface region 44 includes a eutectic composition of the components of the arm portion 40 and the contact portion 42.

Further embodiments of the invention disclosed herein include a method for fabricating a circuit breaker with the monolithic structure 38. Embodiments of the method include starting from powder forms of both the arm portion 40 and the contact portion 42, and then consolidating them together to form the final monolithic structure 38. Some exemplary methods of formation of monolithic structure starting from powders are disclosed below. However, many variations and modifications to the methods described here will occur to those skilled in the art.

Figure 3:
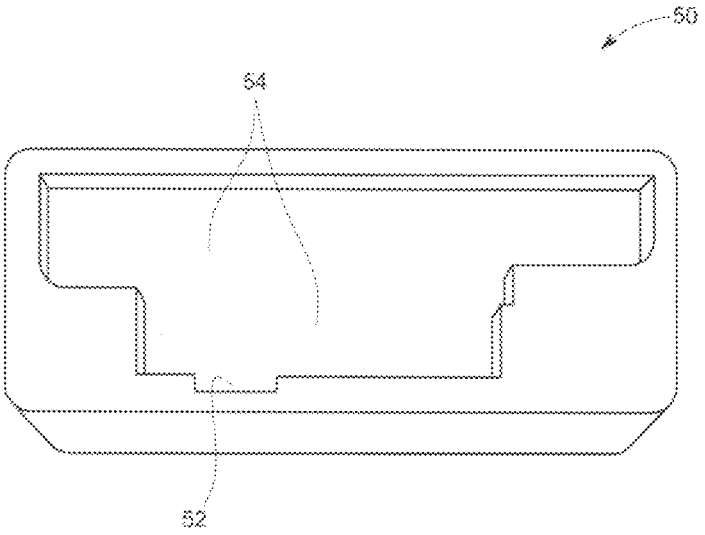
FIG. 3 is a schematic diagram of a mold used to fabricate a monolithic structure, in accordance with one embodiment of the invention.

One embodiment of the method for fabricating a circuit breaker includes using a mold 50 to form the monolithic structure 38 as shown in FIG. 3. The mold 50 includes at least two regions—a first region 52 and a second region 54. The first region 52 of the mold 50 corresponds to the contact portion 42 of the circuit breaker and the second region 54 corresponds to the arm portion 40 of the circuit breaker. Two powders—a first powder and a second powder—were prepared separately. The first powder corresponds to the contact portion 42 of the final monolithic structure 38 and includes materials that correspond to the material of the contact portion 42 at the monolithic structure 38. As used herein the "materials that correspond to the material of the contact portion 42" denotes the material that would eventually become the material of the contact portion 42 after processing. In one embodiment, the first powder is made up of the green powders of the composite material of the contact portion 42 as disclosed earlier, where the composite material includes a metallic matrix and a second phase disposed in the matrix.

The second powder corresponds to the material of the arm portion 40 and includes copper. The second powder may be copper powders, powders of an alloy of copper, or a copper composite powder.

The method further comprises introducing the first powder into the first region 52 of the mold 50 and introducing the second powder into a second region 54 of the mold 50. Depending on the design constraints and ease of packing methods, the first region 52 or the second region 54 may be filled with the respective powders. In one embodiment, the first region 52 is filled with the first powder before the second region 54 is filled with the second powder for the ease of packing.

The first and second powders may then be consolidated to form the monolithic structure 38 having the arm portion 40 and the contact portion 42. In one embodiment, the consolidation includes compacting the powders and sintering.

The mold 50 used herein may be a rigid mold made of a metal, alloy, ceramic, polymer, or a composite. The powders may be directly filled into the rigid mold and then compacted using one or more punches. The first powder in the first region 52 and the second powder in the second region 54 are compacted together (alternately, "co-compacted" or "co-pressed") in the mold. The mold 50 and the punch or punches used may be designed to allow release of the compacted powder. For example, in one embodiment, a mold 50 along with two punches—a top punch (not shown) and a bottom punch (not shown) is used to compact the powders. The compacted powder may be removed in the form of a green body from the mold 50 after removing the top and bottom punches.

The consolidation may be carried out using different methods and combination of steps. For example, in one embodiment, the first powder and the second powder are co-compacted using a rigid mold applying a uniaxial pressure, releasing the compacted green body from the mold 50 and then sintering for densification. In another embodiment, the powders are co-compacted by a hot uniaxial pressing or spark plasma sintering method in the mold 50 to get the final sintered monolithic structure 38. The temperature of co-heating the powders along with uniaxial compaction may be in a range from about 400° C. to about 750° C., depending on the material of the mold, contact portion, and the arm portion.

In one embodiment, the mold 50 is made up of a polymeric material, and can be easily removed after the compaction step using slight heating. In one embodiment, the first powder and the second powder include some sintering aid or binder to assist in easier and lower temperature consolidation. In one embodiment, an epoxy resin and a hardener are mixed with the first and second powders before introducing the powders into the mold 50 to assist in stronger bonding of the powder in the green and sintered body.

In one embodiment, the powders are consolidated by using a flexible mold along with the rigid mold described previously. The flexible mold may be a hollow replica of the monolithic structure 38 with a calculated change in the size. For example, the shrinkage of materials due to sintering may be calculated and the flexible mold may be designed with a corresponding increase in the dimensions to accommodate the shrinkage due to sintering. The dimensions of the rigid mold 50 with or without the usage of flexible mold may also be adjusted to accommodate for the shrinkage due to sintering.

One example of a flexible mold is an elastomeric bag, having a first portion of the elastomeric bag corresponding to the first portion 52 of the mold 50, and a second portion of the elastomeric bag corresponding to the second portion 54 of the mold 50. The materials corresponding to the contact portion 42 may be filled in the first portion of the elastomeric bag first, and then the materials corresponding to the arm portion 40 may be filled in the second portion of the elastomeric bag. The filled elastomeric bag may be sealed and fitted inside the mold 50 and may be subjected to the compaction.

The powders inside the flexible molds such as the elastomeric bag may be subjected to isostatic pressing. Depending on the material of the flexible mold, a cold isostatic pressing (CIP) or a hot isostatic pressing (HIP) method may be used to isostatically co-press the powders corresponding to the contact portion 42 and the arm portion 40 together. Depending on the pressing method used, and the density reached, the compacted green body may be further sintered. In one embodiment, a CIP method is used to co-compact the first and second powders and the obtained green body is subjected to sintering for further consolidation and strength. In one embodiment, the powders are initially co-pressed uni-axially to form the green body, and then cold isostatically or hot isostatically pressed to further densify the green body before conducting any sintering, as needed.

Depending on the chemical composition and size of the first and second powders and the final characteristics of the monolithic structure 38 to be obtained, the sintering temperature may be varied as required. In one embodiment, the co-pressed powders are sintered in a temperature range from about 650° C. to about 1200° C. In one embodiment, the sintering temperature is in the range from about 1000° C. to about 1020° C. In some embodiments, the sintering atmosphere may be controlled to control the characteristics of the final monolithic structure 38 formed. For example, in some embodiments of the invention, the required final product needs to be oxygen-free or have only a minimum amount of oxygen. In such situations, the compacted green body may be sintered in a controlled atmosphere, where the amount of oxygen in the surrounding of the sintering body is controlled. For example, in one embodiment, the green body obtained by the uniaxial or isostatic pressing is sintered in hydrogen, nitrogen, or a forming gas atmosphere. In one embodiment of hot pressing or hot isostatically pressing, the atmosphere around the powders during the pressing step is controlled to be oxygen free.

EXAMPLES

The following examples illustrate materials, methods, and results, in accordance with specific embodiments, and as such should not be construed as imposing limitations upon the claims. All components are commercially available from common suppliers.

In one example, a composite powder having silver as a matrix material with tungsten, tungsten carbide, nickel, or carbon as the second phase was used as the first powder to form the contact portion 42 of the monolithic structure 38. Copper powder was used as the second powder to form the arm portion 40. Copper powders, and the powders of the metal matrix and the second phase typically had a particle size in a range from about 50 nm to about 200 microns. One skilled in the art will appreciate that different particle sizes may be used to formulate the arm portion 40 and the contact portion 42

Example compositions of some of the contact portion 42 materials are given in Table 1. Further, the composition and structure of the arcing surface 46, and the interface 44 may be varied as a result of routine experiments to form a further improved monolithic structure 38.

TABLE 1

| Arm portion | Example Compositions of Contact portion (wt %) |
|---|---|
| 100% Cu | Ag (40-90)—Ni (60-10) |
| 100% Cu | Ag (20-50)—WC (75-48)—Ni (2-5) |
| 100% Cu | Ag (93-99)—C (7-1) |
| 100% Cu | Ag(20-50)—W (80-50) |

Primarily four methods for the formation of the above-mentioned monolithic structure 38 were explored. In one method, a press-sinter-repress (PSR) method was utilized using a uniaxial load of about 6-12 ton over a cross-sectional area of about 5 to 17 $cm^2$ to initially compact the contact portion 42, and the arm portion 40 together. The compacted structure was sintered in a temperature range from about 650° C. to about 1200° C. for a time duration from about 10 minutes to about 60 minutes in an inert atmosphere of about 2-4% hydrogen in nitrogen or argon.

In a second method, the powders were introduced into an elastomeric bag and then cold isostatically co-pressed in a mold 50 with a pressure of about 250 to 415 MPa. The obtained green structure was then sintered in a temperature range from about 650° C. to about 1200° C. for a time duration from about 10 minutes to about 60 minutes in an inert atmosphere of about 2-4% hydrogen in nitrogen or argon.

In a hot pressing method, the starting powders and blends were subjected to a uniaxial load of about 20-45 tons over a cross-sectional area of about 5-17 $cm^2$ pressed at a temperature range from about 650° C. to about 750° C. for about 10-60 minutes hours' time duration.

In another method, spark plasma sintering (SPS) method was used to join the arm portion 40 and the contact portion 42. A pressure of about 30-50 MPa and an effective sintering temperature from about 650° C. to about 775° C. was used for a hold time of about 2-10 minutes duration to compact the structure.

Figure 4A:
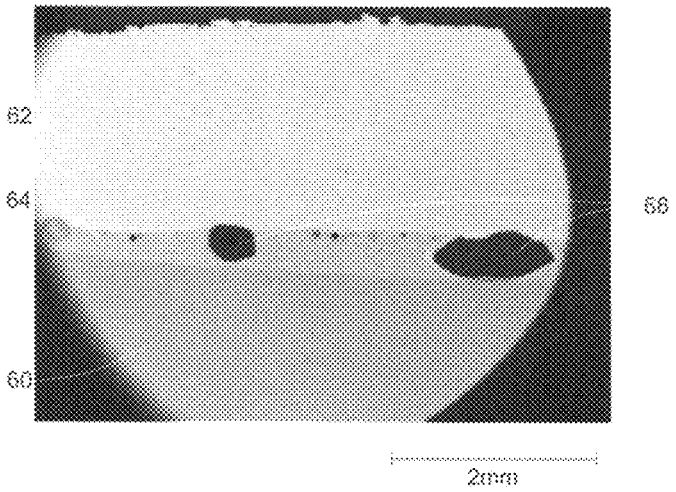
FIG. 4A is a microstructure of conventionally joined arm portion and contact portion of a circuit breaker system.
Figure 4B:
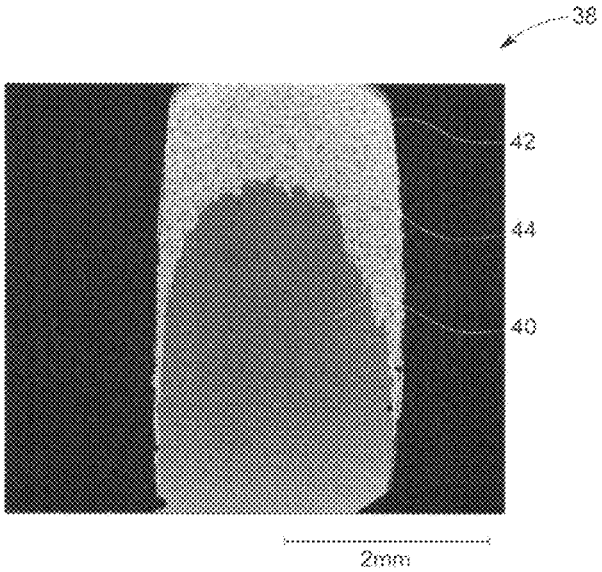
FIG. 4B is a microstructure of the monolithic structure, in accordance with one embodiment of the invention.

Microstructure of a conventionally brazed copper arm portion 60 and a silver matrix based contact portion 62 as shown in FIG. 4A is compared with the monolithic structure 38 of FIG. 4B with the copper arm portion 40 and a contact portion 42 of 70% Ag 30% Ni composite formed by using the methods described in this disclosure. Microstructure of the conventionally brazed samples show voids 68 at the joining interface 64. The amount of voids is found to be in a range of about 10-15 volume %.

The monolith structure 38 formed by co-pressing and co-sintering provided a defect-free interface 44 as shown in FIG. 4B. The density obtained for the monolithic structure 38 was about 96% of the theoretical density. A mechanical shear test showed that the monolithic structure 38 formed by the methods described above did not fail until 2060 Newton.

Figure 5:
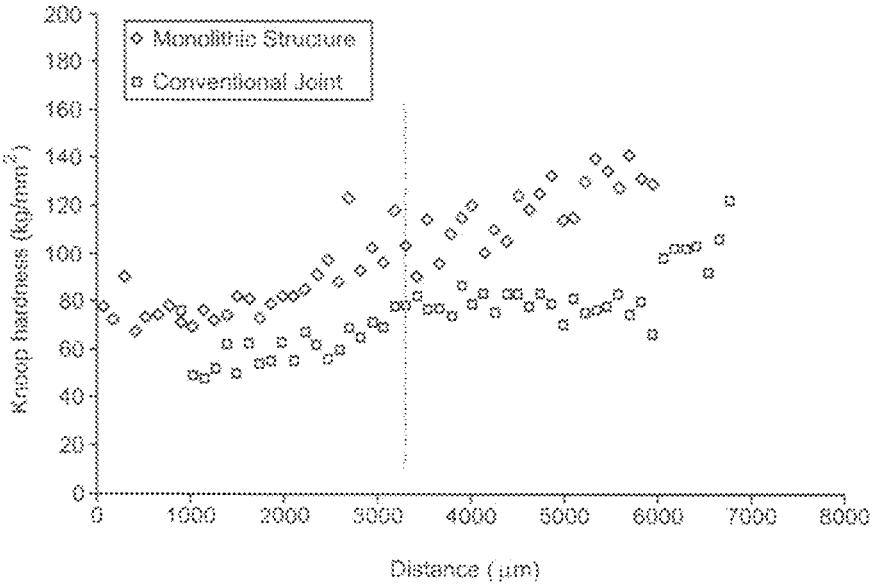
FIG. 5 is a graphical comparison of hardness strength of a conventionally joined structure of a circuit breaker with the hardness strength of the monolithic structure fabricated in accordance with one embodiment of the invention.

FIG. 5 depicts the hardness value of the monolithic structure 38, compared with a commercial sample. Hardness of monolith (~80 $kg/mm^2$ to ~130 $kg/mm^2$) is higher than the commercial sample (~75 $kg/mm^2$).

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A circuit breaker, comprising:
a monolithic structure comprising:
an arm portion comprising copper; and
a contact portion comprising a composite material, the composite material comprising a metallic matrix and a second phase disposed in the metallic matrix, the composite material having a gradient in chemical composition; and
an interface region disposed between the arm portion and the contact portion, wherein the interface region comprises a eutectic composition.

2. The circuit breaker of claim 1, wherein the metallic matrix comprises copper, silver, or combinations thereof.

3. The circuit breaker of claim 1, wherein the second phase comprises a carbide, an oxide, carbon, or combinations thereof.

4. The circuit breaker of claim 1, wherein the metallic matrix comprises copper and the second phase comprises tungsten carbide.

5. The circuit breaker of claim 1, wherein the metallic matrix comprises silver and the second phase comprises cadmium oxide.

6. The circuit breaker of claim 1, wherein the second phase comprises a metal.

7. The circuit breaker of claim 6, wherein the metallic matrix comprises silver and the second phase comprises nickel, tungsten, molybdenum, or combinations thereof.

8. The circuit breaker of claim 7, wherein the composite material comprises about 50 wt % to 80 wt % of tungsten.

9. The circuit breaker of claim 6, wherein the metallic matrix comprises silver.

10. The circuit breaker of claim 1, wherein the monolithic structure further comprises a binder or sintering aid.

11. The circuit breaker of claim 10, wherein the binder or the sintering aid comprises zinc, tin, aluminum, magnesium, silver, cobalt, nickel, iron, or combinations thereof.

12. The circuit breaker of claim 1, wherein the contact portion has less than about 10 volume percent of voids in an interface region.

13. A circuit breaker comprising:
a monolithic structure comprising:
an arm portion comprising copper; and
a contact portion comprising a composite material, the composite material comprising a metallic matrix and a second phase disposed in the metallic matrix, the composite material having a gradient in chemical composition;
wherein the gradient is from an arcing portion of the contact portion to an interface between the arm portion and the contact portion.

14. A circuit breaker, comprising:
a monolithic structure comprising:
an arm portion comprising copper; and
a contact portion comprising a composite material, the composite material comprising a metallic matrix and a second phase disposed in the metallic matrix, the composite material having a gradient in chemical composition;
wherein the gradient is from an arcing portion of the contact portion to a center of the contact portion; and
an interface region disposed between the arm portion and the contact portion, wherein the interface region comprises a eutectic composition.

15. The circuit breaker of claim 14, wherein the second phase has a higher concentration at the center than at the arcing portion.

* * * * *